United States Patent [19]

Smith

[11] 4,057,094

[45] Nov. 8, 1977

[54] CAR WINDOW SCREEN

[76] Inventor: Thomas Smith, 4511 W. Grenshaw, Chicago, Ill. 60624

[21] Appl. No.: 706,270

[22] Filed: July 19, 1976

[51] Int. Cl.[2] ..... E06B 9/52

[52] U.S. Cl. ..... 160/37; 160/90; 160/103

[58] Field of Search ..... 160/103, 37, 90, 102, 160/189

[56] References Cited

U.S. PATENT DOCUMENTS

| | | | |
|---|---|---|---|
| 1,692,247 | 11/1928 | Cleveland | 160/103 |
| 2,016,645 | 10/1935 | Maddox | 160/103 |
| 2,625,218 | 1/1953 | Nihon | 160/103 |
| 2,710,058 | 6/1955 | Gronlund et al. | 160/103 |

*Primary Examiner*—Peter M. Caun

[57] ABSTRACT

An apparatus for selectively moving a transparent pane and a screen pane across a window opening includes first and second mechanisms for moving the transparent and screen panes, respectively, from a respective first position covering the opening, and inhibiting means for preventing the movement of the screen pane from the first and second positions thereof upon the transparent pane occupying a position other than the latter's first position but not yet at the second position.

1 Claim, 3 Drawing Figures

CAR WINDOW SCREEN

BACKGROUND OF THE INVENTION

1. Field of the Invention

The field of the present invention relates to a car window screen.

2. Description of the Prior Art

A screening device for automobiles is known wherein a transparent pane and a screen pane are movable across a window opening, a common handle being provided for selectively actuating the transparent pane or the screen pane. It will be appreciated, though, that the screen pane may purposefully only cover the window opening entirely or leave it only completely uncovered, while the transparent pane may occupy any position, including a position intermediate between the position covering the window opening, and the position leaving the window uncovered. This is so because the screen pane is intended to prevent insects from coming into the vehicle, and it would serve no useful purpose to leave the screen pane in a position midway or intermediate between the aforesaid extreme two positions.

SUMMARY OF THE INVENTION

It is accordingly an object of my present invention to devise an apparatus for selectively moving a transparent pane and a screen pane across a window opening in such a manner that the screen pane may only occupy a first position, leaving the opening uncovered, and a second position covering the opening. The aforesaid automatic positioning constraints free the driver or passenger of the car from responsibility of avoiding the positioning of the screen pane into positions which are not useful, and permits him to attend to his other responsibilities. I accordingly provide an apparatus for selectively moving a transparent pane and a screen pane across a window opening which includes first and second mechanisms for moving the transparent and screen panes, respectively, from a respective first position leaving the opening uncovered, to a respective second position covering the opening, and inhibiting means for preventing the movement of the screen pane from the first and second positions thereof upon the transparent pane occupying a position other than the latter's first position. The first and second mechanisms include respective segmental gears disposed on one side of the panes, respective pinions engaging the gears, and each of the pinions includes a handle for the rotation thereof. Each of the panes has a respective lower end-portion formed with a longitudinal slit, and each of the gears includes an arm rigid therewith which has an end thereof adapted to slide within one of the slits. A rotation of one of the handles causes the handle-associated pane to move across the window opening. The inhibiting means include a first belt means and first belt-supporting means so that the second belt means can be moved by the handle of the second mechanism; the first belt-means has narrower and wider portions of first and second lengths, respectively, and the second belt means has a plurality of substantially equispaced longitudinal pins thereon, and is disposed transversely to the first belt means. The wider portion of the first belt means is operatively contactable by at least two successively spaced pins, and the narrow portion thereof is operatively non-contactable by the pins. The length of the wider portion corresponds to the distance for the transparent pane to operatively move from the first to the second position, so that the handle of the second mechanism is substantially prevented from being rotated upon the wider portion of the first belt means being interposed between the two successively spaced pins.

BRIEF DESCRIPTION OF THE DRAWING

My invention will be better understood with the aid of the accompanying drawing in which.

DESCRIPTION OF THE PREFERRED EMBODIMENT

Figure 1:
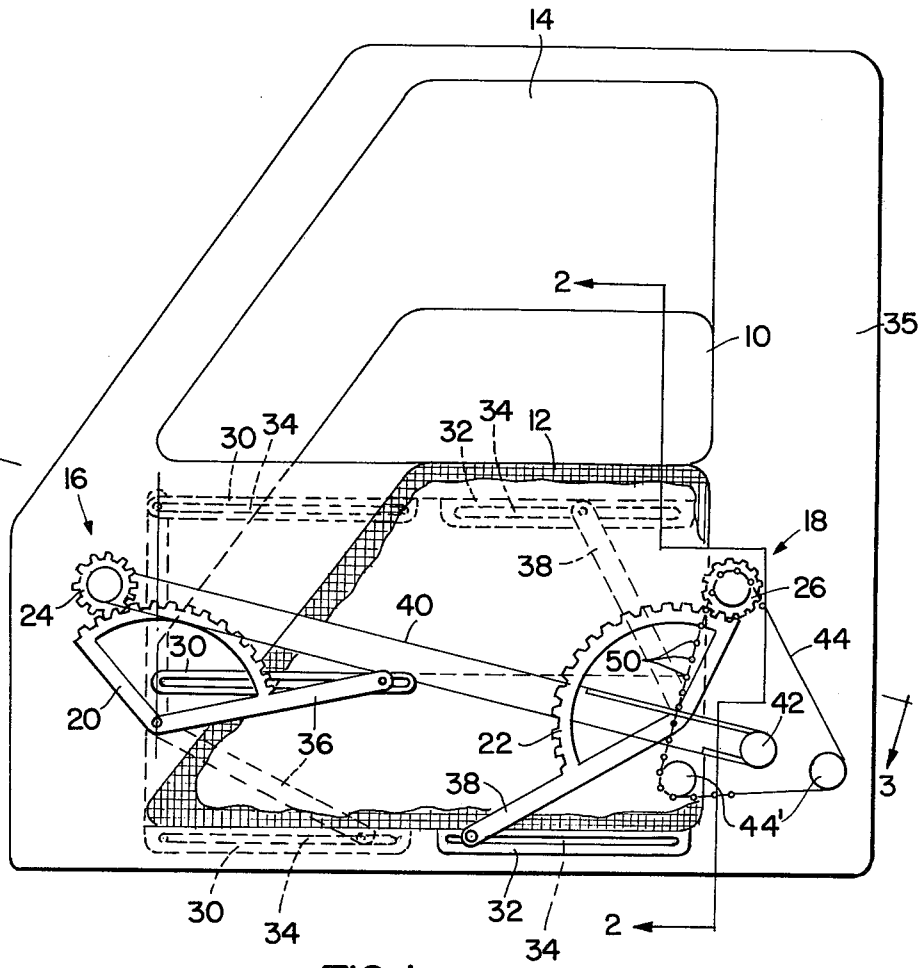
FIG. 1 shows an elevational view of the apparatus, according to my invention, in partial section.
Figure 2:
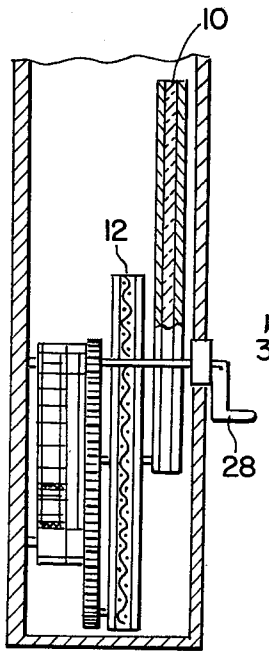
FIG. 2 shows a cross section along the lines 2—2 of FIG. 1.
Figure 3:
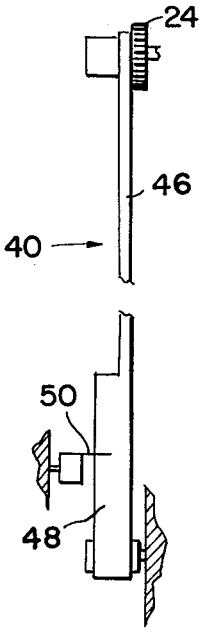
FIG. 3 is a fragmentary plan view of the first belt viewed along the lines 3—3 of FIG. 1.

Referring now to the drawing, an apparatus for selectively moving a transparent pane 10 such as a glass pane, and a screen pane 12 across a window opening 14 includes a first mechanism 16, and a second mechanism 18 for moving the transparent pane 10 and the screen pane 12, respectively, from a respective first position leaving the opening 14 uncovered, to a respective second position covering the opening 14, and inhibiting means for preventing the movement of the screen pane 12 from the first and second positions thereof upon the transparent pane occupying a position other than the latter's first position. The mechanisms 16 and 18 include respective segmental gears 20 and 22 disposed on one side of the panes 10 and 12, and respective pinions 24 and 26 engage the gears 20 and 22; each of the pinions 24 and 26 includes a handle for the rotation thereof. The panes 10 and 12 have respective lower end portions 30 and 32, each pane being formed with a longitudinal slit 34, and each of the gears 20 and 22 includes a respective arm 36 and 38 rigid therewith and having an end thereof adapted to slide within one of the slits 34; a rotation of one of the handles 28 causes the handle-associated pane to move across the window opening 14. The inhibiting means include first belt means 40, and first belt-supporting means 42 in the form of a roller attached to a door frame 35, so that the first belt means 40 can be moved by the handle 28 of the first mechanism 16, second belt means 44, and second belt-supporting means attached to the door frame 35 in the form of two rollers 44', so that the second belt-means 44 can be moved by the handle 28 of the second mechanism 18. The first belt means 40 has a narrower portion 46, and a wider portion 48 of first and second lengths, respectively, and the second belt means 44 has a plurality of substantially equispaced longitudinal pins 50 disposed thereon; the second belt means 44 is disposed transversely to the first belt means 40, and the second length of the wider portion 48 of the first belt means 40 may be operatively contacted by at least two successively spaced pins 50, while the narrow portion 46 is not operatively contactable by the pins 50. The length of the wider portion 48 corresponds to the distance of the transparent panel 10 to operatively move from the first to the second position; the handle 28 of the second mechanism 18 is thus substantially prevented from being rotated upon the wider portion 48 of the first belt means 40 being interposed between the two successively spaced pins 50.

Although the invention has been described with respect to a preferred version thereof, it is to be understood that it is not to be so limited since changes can be made therein which are within the full intended scope of the appended claims.

What is claimed is:

1. An apparatus for selectively moving a transparent pane and a screen pane across a window opening comprising:

first and second mechanisms for moving said transparent and screen panes, respectively, from a respective first position leaving the opening uncovered, to a respective second position covering said opening, said mechanisms including respective segmental gears disposed on one side of the panes, respective pinions engaging said gears, each of said pinions including a handle for the rotation thereof, and wherein said panes have respective lower end portions formed with a longitudinal slit, and each of said gears includes an arm rigid therewith having an end thereof adapted to slide within one of said slits, and inhibiting means for preventing the movement of said screen pane from the first and second positions thereof upon said transparent pane occupying a position other than the latter's first position but not yet at the second position, said inhibiting means including first belt-means, first belt-supporting means attached to a door frame for said first belt-means to be movable by the handle of said first mechanism, second belt-means and second belt-supporting means attached to the door frame for said second belt-means to be movable by the handle of said second mechanism, said first belt-means having narrower and wider portions of first and second lengths, respectively, and said second belt-means having a plurality of substantially equi-spaced longitudinal pins thereon, and being disposed transversely to said first belt-means, and wherein said second length of said wider portion of said first belt-means is operatively contactable by at least two successively spaced pins, said narrow portion being operatively non-contactable by said pins, said second length of said wider portion corresponding to the distance for said transparent pane to operatively move from said first to said second position, whereby a rotation of one of said handles causes the handle-associated pane to move across the window opening and the handle of said second mechanism is substantially prevented from being rotated upon said wider portion of said first belt-means being interposed between said two successively spaced pins.

* * * * *